United States Patent [19]

Kozuka et al.

[11] Patent Number: 5,072,206

[45] Date of Patent: Dec. 10, 1991

[54] LINEAR-MOVEMENT POTENTIOMETER

[75] Inventors: Hajime Kozuka, Okazaki; Naoki Saito, Maebashi; Hiromasa Ozawa, Himeji, all of Japan

[73] Assignees: Nippon Seiko Kabushiki Kaisha; Mitsubishi Denki Kabushiki Kaisha, both of Tokyo, Japan

[21] Appl. No.: 433,296

[22] Filed: Nov. 8, 1989

[30] Foreign Application Priority Data

Nov. 8, 1988 [JP] Japan ..... 63-282075

[51] Int. Cl.[5] ..... H01C 1/02

[52] U.S. Cl. ..... 338/184; 338/164; 338/176; 338/183

[58] Field of Search ..... 338/183, 184, 176, 164

[56] References Cited

U.S. PATENT DOCUMENTS

| | | | |
|---|---|---|---|
| 3,456,228 | 7/1969 | Wright | 338/176 |
| 3,621,438 | 11/1971 | Wright | 338/176 |
| 4,473,814 | 9/1984 | Blessing | 338/176 |
| 4,523,514 | 6/1985 | Burk | 338/184 X |

*Primary Examiner*—Marvin M. Lateef

*Attorney, Agent, or Firm*—Sughrue, Mion, Zinn, Macpeak and Seas

[57] ABSTRACT

A linear-movement potentiometer having an operating rod 25 projecting at both ends from a substantially hermetic casing and connectable at one end 26 to a drive member, and first and second bearings 33, 34 disposed between the casing and the operating rod for supporting the operating rod for a linear sliding motion relative to the casing. A sealing arrangement is provided between the casing and both ends of the operating rod. A sliding variable resistor assembly 38 including a resistor and a contact relatively slidable with each other is disposed within the casing, and one of the resistor and the contact is operatively connected to the operating rod for establishing a relative sliding movement between the resistor and the contact. A cover 54 may be sealingly secured to the casing for covering the end of the operating rod, and the operating rod may have an air passage 28 axially extending therethrough.

7 Claims, 2 Drawing Sheets

LINEAR-MOVEMENT POTENTIOMETER

BACKGROUND OF THE INVENTION

This invention relates to a linear-movement potentiometer and more particularly to a linear-movement potentiometer particularly suitable for use in a steering torque detecting unit of an automotive power steering system.

FIG. 1 is a sectional view showing a conventional linear-movement potentiometer to which the present invention pertains. In FIG. 1, reference numeral 1 designates a caing, 2 is an operating rod, 3 is a cover, 4 is a sleeve bearing, 5 is a carrier, 6 is a substrate, 7 is a slider contact, 8 are terminals, 9 are springs, 10 are lead wires, 11 is a grommet, 12 is a guide rail, 13 is a filler resin, 14 is a vent hole, 15 is a spring and 16 is an engagement aperture.

FIG. 2 is a plan view illustrating in detail the positional relationship between the substrate 6 and the slider contact 7 shown in FIG. 1. *6a* is a collector printed on the substrate 6 and *6b* is a resistor also printed on the substrate. As illustrated in FIG. 2, the slider contact 7 bridges between and slidably contacts with the collector *6a* and the resistor *6b*.

Referring again to FIG. 1, the slider contact 7 is secured to the carrier 5 which is guided by a guide rail 12 for a linear movement therealong, and the carrier 5 is securely mounted to the operating rod 2. The operating rod 2 is connectable at an outer end through the engagement aperture 16 to a mechanism for converting the torsion angle in the torsion bar of a steering shaft between an input end (a steering wheel side) and an output end (a steering gear side) into a linear displacement. Thus, when the operating rod 2 linearly moves, and the slider contact 7 correspondingly moves, an electrical signal (voltage) proportional to the above-mentioned torsion angle can be be obtained from the lead wire 10. This voltage signal causes a steering motor connected to the steering shaft to be driven to operate the automotive power steering system.

When assembling the potentiometer, after the operating rod 2 having the carrier 5 secured thereon is inserted into the casing 1 and through the sleeve bearing 4, the substrate 6 is inserted between the springs 9 and the slider contact 7 on the carrier 5. Then, after the cover plate 3 is fitted to hold the substrate 6 by the spring 15, the filler resin 13 is poured to hold the cover plate 3 and the lead wires 10.

As the operating rod 2 moves inward and outward with respect to the casing 1, the volume of the inner space varies and the air pressure within the casing changes accordingly, whereby a pressure difference which impedes smooth movement of the operating rod 2 appears between the exterior and the interior of the casing 1. In order to prevent such a pressure difference from being generated, the bottom wall of the casing 1 is provided with the vent hole 14. Although not illustrated, instead of the vent hole 14 formed in the bottom wall of the casing 1, a relatively large clearance may be made between the operating rod 2 and the sleeve bearing 4 for allowing the air to pass therethrough.

With the above structure of the conventional potentiometer, moisture or water drops can relatively easily enter into the casing through the vent hole 14 or the clearance between the operating rod 2 and the sleeve bearing 4. The moisture entered into the casing 1 may generate erroneous electric signals when attached to the resistor *6b* or generate rust on the slider or the like.

SUMMARY OF THE INVENTION

Accordingly, one object of the present invention is to provide a linear-motion potentiometer free from the above discussed problems of the conventional design.

Another object of the present invention is to provide a linear-motion potentiometer in which the smooth movement of the operating rod is not impeded by the compressed or expanded air within the casing.

Another object of the present invention is to provide a linear-motion potentiometer in which moisture is prevented from entering into the casing.

A further object of the present invention is to provide a linear-motion potentiometer in which the operating rod can be smoothly moved and moisture is prevented from entering into the casing.

With the above objects in view, the linear-movement potentiometer of the present invention comprises an operating rod projecting at both ends from a substantially hermetic casing and connectable at one end to a member by which the potentiometer is to be driven, and a first and a second bearing disposed between the casing and the operating rod for supporting the operating rod for a linear sliding motion relative to the casing. A sealing liquid tight arrangement is provided between the casing and both ends of the operating rod. A sliding variable resistor assembly including a resistor and a contact relatively slidable with each other is disposed within the casing, and one of the resistor and the contact is operatively connected to the operating rod for establishing a relative sliding movement between the resistor and the contact.

A cover may be sealingly secured to the casing for covering the end of the operating rod, and the operating rod may have an air passage axially extending therethrough.

BRIEF DESCRIPTION OF THE DRAWINGS

The present invention will become more readily apparent from the following detailed description of the preferred embodiment of the present invention taken in conjunction with accompanying drawings, in which.

DESCRIPTION OF THE PREFERRED EMBODIMENT

Figure 3:
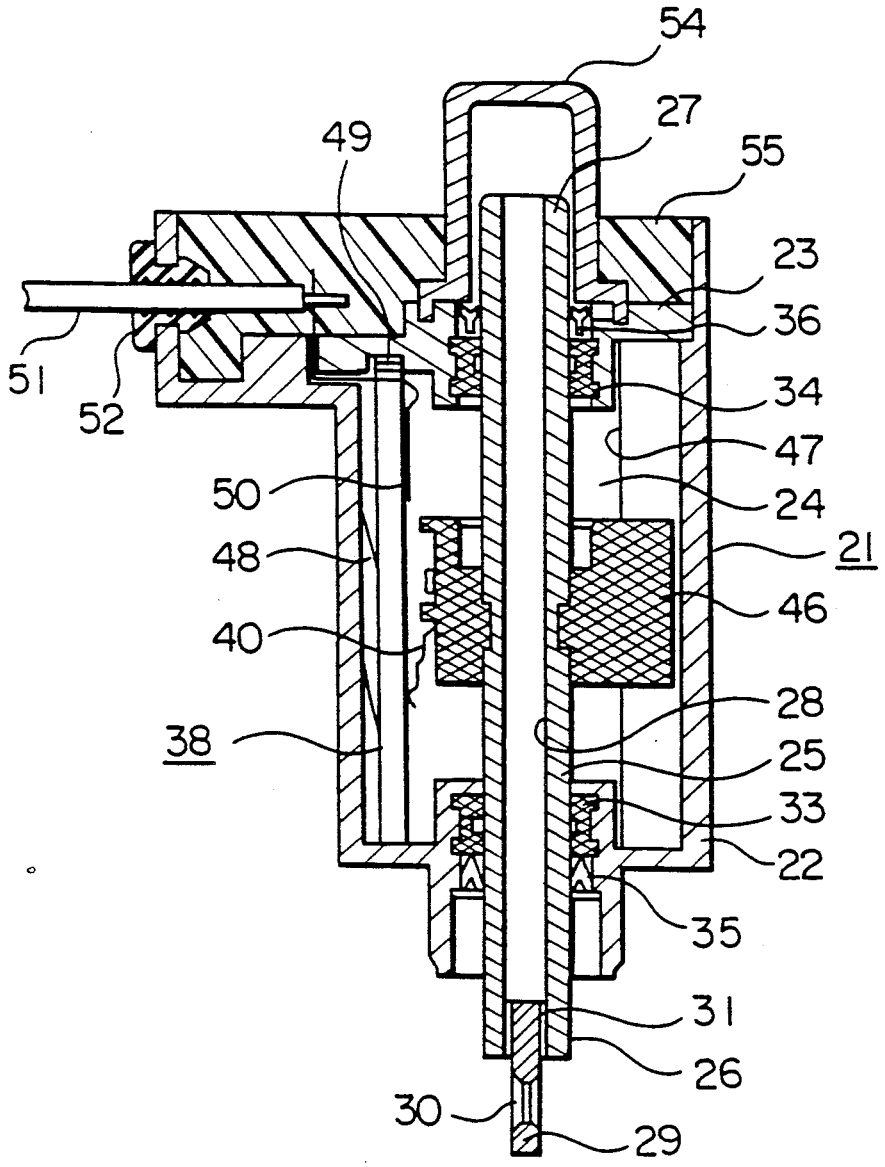
FIG. 3 is a sectional view of a linear-movement potentiometer of an embodiment of the present invention.

FIG. 3 illustrates one embodiment of a linear-movement potentiometer of the present invention. The linear-movement potentiometer comprises a substantially hermetric casing 21 having a main body 22 and a cover plate 23 attached to the main body 22 to define a space 24 therein. An operating rod 25 extends through the casing 21 and has a first end 26 projecting from the casing 21 and connectable to a movable member on a steering wheel side (not shown) and a second end 27 projecting from the casing 21. The operating rod 25 has formed therein an air passage 28 axially extending therethrough between the first and the second ends 26 and 27. The first end 26 of the operating rod 25 has an engagement member 29 having an engagement aperture 30. The engagement member 29 may be a substantially plate-like member which is press-fit into the inner cylindrical surface of the air passage 28 in the first end 26 of the operating rod 25 and which defines a pair of clearances 31 between the major surfaces of the engagement member 29 and the inner surface of the air passage 28. Alternatively, the engagement member 29 may be integrally formed with the operating rod 25.

The operating rod 25 is supported by a first bearing 33 and a second bearing 34 disposed at the bottom wall of the casing main body 22 and the cover plate 23, respectively, of the casing 21 to allow smooth axial sliding movement relative to the casing 21.

A seal ring 35 is disposed between the casing 21 and the first end 26 of the operating rod 25, and a seal ring 36 is disposed between the casing 21 and the second end 27 of the operating rod 25 for liquid tight sealing therebetween. It is seen that the seal rings 35 and 36 at the opposite end portions are disposed axially outside of the sleeve bearings 33 and 34.

Figure 1:
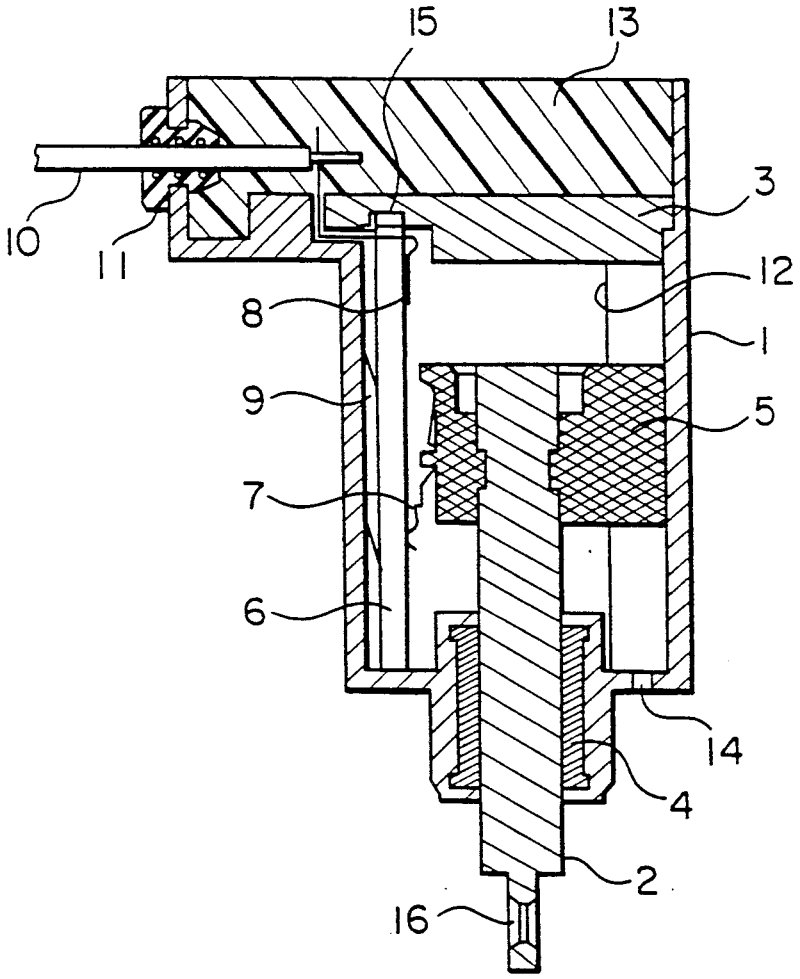
FIG. 1 PRIOR ART
FIG. 1 is a sectional view of a conventional linear-movement potentiometer.
Figure 2:
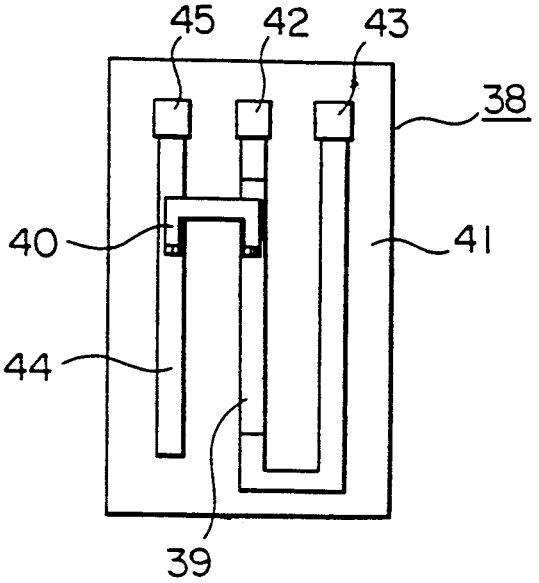
FIG. 2 is a plan view illustrating the sliding variable resistor assembly employed in the potentiometer.

The potentiometer also comprises a sliding variable resistor assembly 38 disposed within the casing 21 and including a resistor element 39 and a sliding contact 40 slidable on and along the resistor element 39 and connected to the operating rod 25 for establishing a relative sliding movement between the resistor element 39 and the sliding contact 40. As best seen from FIG. 2, the resistor element 39 is a strip or a layer of a substantially U-shaped strip of an electrically conductive material attached to a substrate or an electrically insulating board 41. The resistor element 39 is provided with terminals 42 and 43 at opposite ends for electrical connections. An electrically conductive strip or a collector element 44 having a terminal 45 is also provided on the substrate 41. The sliding contact 40 is an electrically conductive elastic material bridging between the resistor element 39 and the collector element 44 to establish a sliding electrical connection therebetween.

The sliding contact 40 is mounted on an electrically insulating slider block 46 which is securely mounted on the operating rod 25 for a linear movement therewith and guided by a guide rail 47 formed on the inner surface of the casing main body 22. The insulating board 41 on which the resistor element 39 and the collector element 44 are formed is inserted into grooves (not shown) formed in the casing main body 22. The insulating board 41 is spring biased by springs 48 inserted between the back side of the board 41 and the casing main body 22 as well as by a spring 49 inserted between the upper side edge of the board 41 and the cover plate 23 so that the board 41 is resiliently held in position.

The electrical connection between the variable resistor assembly 38 within the casing 21 and an external circuit (not shown) is established by lead wires 50 connected at one end to the terminals 42, 43 and 45 on the board 41 and at the other end to lead conductors 51 firmly mounted to the casing 21 through a grommet 52 and extending outwardly of the casing 21.

It is preferable that the upper or the second end 27 of the operating rod 25 is covered by a cover 54 for preventing entry of water into the interior space 24 of the casing 21. The cover 54 is a substantially cup-shaped member sealingly secured at its open end to the cover plate 23. In the illustrated embodiment, the open end of the cover 54 is inserted into an annular groove formed in the cover plate 23 around the seal ring 36. In this embodiment, in order to prevent compression or expansion of the air within the cover 54 as the operating rod 25 is actuated, the air passage 28 formed in the rod 25 is necessary. The upper portion of the casing 21 including the cover 54, the lead wires 50 and 51 as well as the cover plate 23 are secured in place by a resinous filler material 55.

With this arrangement, since the first and the second ends 26 and 27 project outside of the casing 21 through the seals 35 and 36, the volume of the space 24 defined within the casing 21 does not change even when the operating rod 25 is moved, so that the movement of the operating rod 25 is not impeded by compression or expansion of air within the space 24. Since the interior space 24 is sealed by seal rings 35 and 36, it is completely isolated from the surrounding environment. Also, the water cover 54 mounted to the casing 21 can provid a further water resistance to the casing 21.

As has been described, the linear-movement potentiometer of the present invention comprises an operating rod projecting at both ends from a substantially hermetic casing and connectable at one end to a member according to which the potentiometer is to be driven and a first and a second bearing disposed between the casing and the operating rod for supporting the operating rod for a linear sliding motion relative to the casing. A sealing arrangement is provided between the casing and both ends of the operating rod therebetween, and a sliding variable resistor assembly including a resistor and a contact is disposed within the casing and is operatively connected to the operating rod. Also, a cover may be sealingly secured to the casing for covering the end of the operating rod, and the operating rod may have an air passage axially extending therethrough.

Therefore, the internal pressure within the casing does not change when the operating rod 25 moves and is isolated from the exterior, so that the smooth movement of the operating rod is not impeded and no moisture enters into the interior of the casing, whereby the reliability and the operating life of the potentiometer are improved.

What is claimed is:

1. A linear-movement potentiometer comprising:

a substantially hermetic casing (21) defining a space (24) therein;

an elongate, slidable operating rod (25) extending completely through opposite ends of said casing such that a first end (26) of said rod projects outwardly from one end of said casing for connection to a movable member, and a second end (27) of said rod projects outwardly from another, opposite end of said casing;

first and second longitudinally spaced bearings (33, 34) individually disposed between said ends of the casing and said first and second ends of said operating rod for supporting said operating rod for a linear sliding motion relative to said casing;

first and second longitudinally spaced seal means (35, 36) individually disposed between said ends of the casing and said first and second ends of said operating rod for liquid-tight sealing therebetween; and a sliding variable resistor assembly (38) disposed within said casing and including a resistor and a contact relatively slidable with each other, one of said resistor and said contact being operatively connected to said operating rod via a slider block (46) for establishing a relative sliding movement between said resistor and said contact, wherein said slider block is spaced from the casing to establish open air communication across the block and to attendantly enable rapid movement of the slider block without any air pressure impediment.

2. A linear-movement potentiometer as claimed in claim 1, comprising a cover (54) for preventing entry of water sealingly secured to said casing and covering said second end of said operating rod, and said operating rod having an air passage (28) extending therethrough between said first and said second ends.

3. A linear-movement potentiometer as claimed in claim 1, said second end of said operating rod including a plate member (29) having an engagement aperture (30) formed therein.

4. A linear-movement potentiometer as claimed in claim 1, wherein the resistor is resiliently mounted within the casing.

5. A linear-movement potentiometer as claimed in claim 1, wherein the first and second bearings are discrete components, the first and second seal means are discrete components, and the first and second seal means are disposed outwardly of the respective first and second bearings.

6. A linear-movement potentiometer comprising:

a substantially hermetic casing (21) defining a space (24) therein;

an elongate, slidable operating rod (25) extending completely through opposite ends of said casing such that a first end (26) of said rod projects outwardly from one end of said casing for connection to a movable member, and a second end (27) of said rod projects outwardly from another, opposite end of said casing;

first and second longitudinally spaced bearings (33,34) individually disposed between said ends of the casing and said first and second ends of said operating rod for supporting said operating rod for a linear sliding motion relative to said casing;

first and second longitudinally spaced seal means (35,36) individually disposed between said ends of the casing and said first and second ends of said operating rod for liquid-tight sealing therebetween; and a sliding variable resistor assembly (38) disposed within said casing and including a resistor and a contact relatively slidable with each other, one of said resistor and said contact being operatively connected to said operating rod for establishing a relative sliding movement between said resistor and said contact, further comprising a cover (54) for preventing entry of water sealingly secured to said casing and covering said second end of said operating rod, and said operating rod having an air passage (28) extending therethrough between said first and said second ends.

7. A linear-movement potentiometer comprising:

a substantially hermetic casing (21) defining a space (24) therein;

an elongate, slidable operating rod (25) extending completely through opposite ends of said casing such that a first end (26) of said rod projects outwardly from one end of said casing for connection to a movable member, and a second end (27) of said rod projects outwardly from another, opposite end of said casing;

first and second longitudinally spaced bearings (33,34) individually disposed between said ends of the casing and said first and second ends of said operating rod for supporting said operating rod for a linear sliding motion relative to said casing;

first and second longitudinally spaced seal means (35,36) individually disposed between said ends of the casing and said first and second ends of said operating rod for liquid-tight sealing therebetween; and a sliding variable resistor assembly (38) disposed within said casing and including a resistor and a contact relatively slidable with each other, one of said resistor and said contact being operatively connected to said operating rod for establishing a relative sliding movement between said resistor and said contact, wherein said second end of said operating rod includes a plate member (29) having an engagement aperture (30) formed therein.

* * * * *